US005359786A

United States Patent [19]

Vierling

[11] Patent Number: 5,359,786

[45] Date of Patent: Nov. 1, 1994

[54] APPARATUS FOR AFTERTREATING DRYCLEANED GARMENTS

[76] Inventor: Paul F. Vierling, Wallstr. 3, D-2953, Rhauderfehn, Germany

[21] Appl. No.: 770,034

[22] Filed: Oct. 4, 1991

Related U.S. Application Data

[63] Continuation of Ser. No. 678,848, Apr. 4, 1991, abandoned, which is a continuation of Ser. No. 623,334, Dec. 4, 1990, abandoned.

[30] Foreign Application Priority Data

Apr. 4, 1989 [DE] Germany ..... 3910808

[51] Int. Cl.[5] ..... F26B 13/30

[52] U.S. Cl. ..... 34/92; 34/218

[58] Field of Search ..... 34/17, 18, 60, 92, 218, 34/219; 8/142

[56] References Cited

U.S. PATENT DOCUMENTS 3,889,389 6/1975 Serup ..... 34/92 X 4,257,173 3/1981 Smith ..... 34/92

*Primary Examiner*—Henry A. Bennett

*Attorney, Agent, or Firm*—Wegner, Cantor, Mueller & Player

[57] ABSTRACT

The invention relates to an apparatus for carrying out a process for aftertreating garments cleaned dried by means of at least one organic solvent such as for example perchlorethylene and/or other chlorinated hydrocarbons or the like, in which, for the purpose of removing solvent residues after their actual drycleaning, the garments, while being hung up for airing and/or preferably smoothing, are treated with steam and/or air.

10 Claims, 1 Drawing Sheet

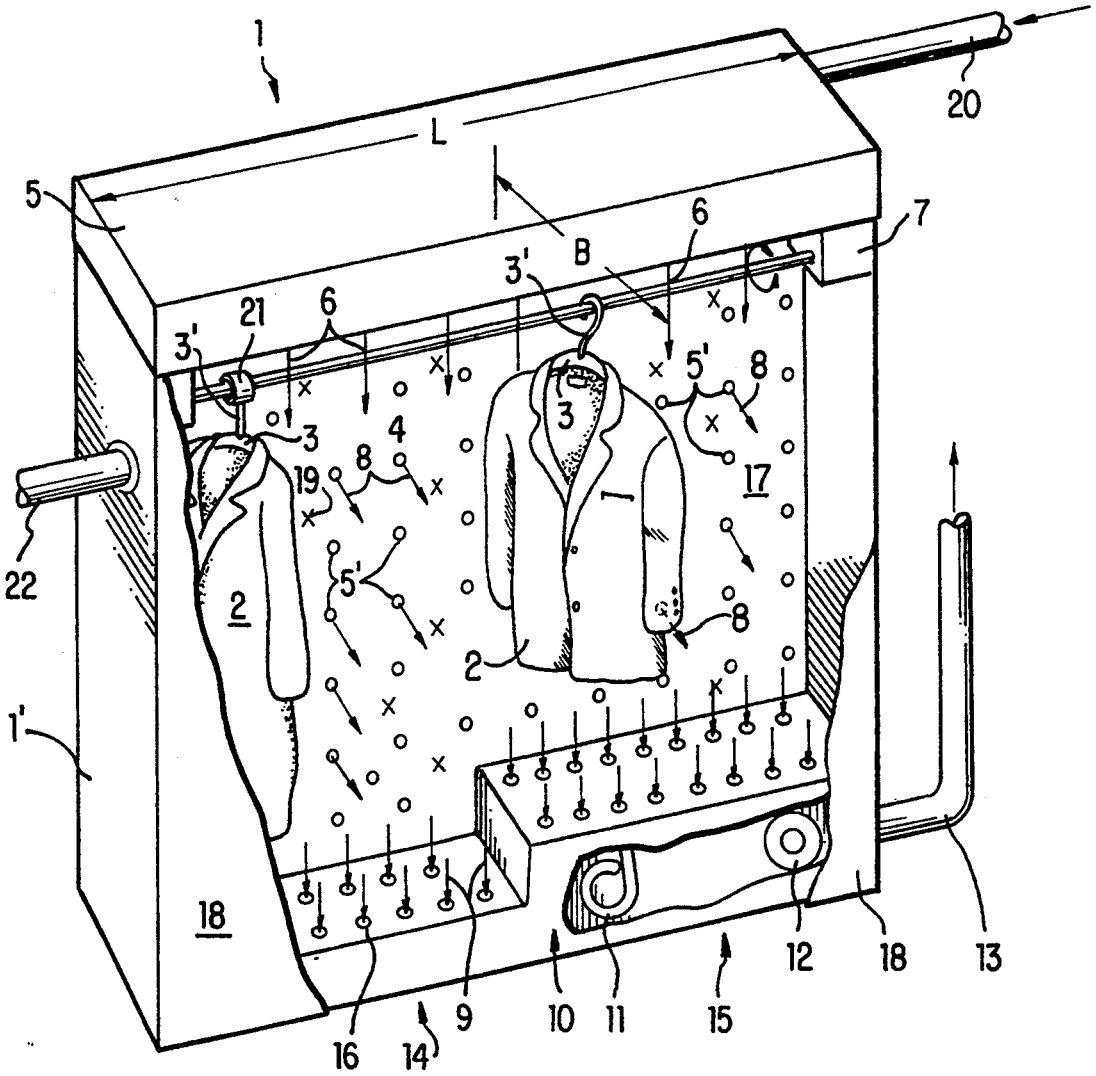
1
L
20
5
B
6
7
3'
21
6
3'
5'
8
3
4
3
19
8
17
22
5'
2
8
2
1'
18
12
18
13
16
14
9
10
11
15

APPARATUS FOR AFTERTREATING DRYCLEANED GARMENTS

This application is a continuation of Ser. No. 07/678,848, filed Apr. 4, 1991 now abandoned, which is a continuation of Ser. No. 7/623,334, filed Dec. 4, 1990 now abandoned, which in turn is a continuation of Patent Cooperation Treaty application No. PCT/DE90/00275, filed Apr. 4, 1990.

The invention relates to a process for aftertreating garments cleaned dry by means of at least one organic solvent such as for example in particular perchloroethylene (also abbreviated to "perc" in the field) or/and other chlorinated hydrocarbons or the like, in which, for the purpose of removing solvent residues after their actual drycleaning, the garments, while being hung up for airing and/or preferably smoothing, are treated with steam and/or air, and to an apparatus for carrying out such a process.

Any reference hereinbefore or hereinafter to an "aftertreatment" of drycleaned garments is to be understood as meaning a (preferably final or finishing) treatment of (essentially outerwear) garments which, for the purpose of cleaning them, have previously already been drycleaned but, after drycleaning, are not as yet directly usable again since they still contain not inconsiderable quantities of the drycleaning solvent or solvents and/or generally in addition require a smoothing treatment.

DE Offenlegungsschrift No. 2,146,945 discloses a process and apparatus for cleaning garments of which the apparatus is intended for major cleaning installations—and not for example for minor, shop cleaning operations. The concern of DE Offenlegungsschrift No. 2,146,945 is that the then prior art used a relatively large amount of solvent and that the garments to be cleaned were subjected to vigorous mechanical agitation in the course of the cleaning process and were relatively creased in the subsequent drying process, so that it had also already been proposed at the time (see CA Pat. 683,630) that the garments, hung up in the course of the cleaning process in a closet-like booth, be sprayed with solvent while being subjected to a slight vibration and then be dried and also aired in the airstream. However, this was said to be uneconomically time-consuming, so that it was said to be the object of DE Offenlegungsschrift 2,146,945 to solve the problem of reducing the (total) time required for the cleaning process (including the aftertreatment), i.e. to practice the entire process sequence of cleaning—drying—finishing by steam ironing in a single operation.

Apart from the fact that the apparatus known from DE Offenlegungsschrift 2,146,945 is, as mentioned earlier, basically suitable only for major cleaning installations and not for minor units as are used in shop operations (given the investment level which can be expected of such operations, available space etc.), the author of the subject-matter of DE Offenlegungsschrift No. 2,146,945 evidently also did not realize the residual solvent problem or at any rate did not provide any technical teaching as to how this problem might be effectively solved.

It is a moot point whether the subject-matter of DE Offenlegungsschrift No. 2,146,945 can be used (in connection with major cleaning installations) to achieve effective cleaning of garments with subsequent drying and effective smoothing. At any rate, an effective aftertreatment with an effective removal of solvent residues from the previously drycleaned garments is not possible with the subject-matter of DE Offenlegungsschrift 2,146,945.

An appreciable residual solvent content, in particular of halogenated solvents such as perchloroethylene (=tetrachloroethylene)—the preferred drycleaning solvent—is particularly problematical if only because this substance is, at least in higher concentrations, a suspected carcinogen, so that the residual levels in drycleaned garments and the levels released into the environment with the waste steam and/or air must be kept to a minimum. This is also true of course of other drycleaning solvents, for example trichlorotrifluoroethane, this latter solvent, which is also designated R 113, being additionally handicapped by the fact that it belongs to the class of the chlorofluorocarbons (CFCs) which are seriously suspected of having an adverse effect on the ozone layer in the atmosphere, which is important for life on earth.

Similarly, the author (=inventor) of the subject-matter of the present patent application—evidently like everybody else in the trade—initially assumed in the course of his extensive development work that the successful aftertreatment of previously drycleaned garments would merely require skillful application to the previously drycleaned garments (namely exclusively from above and/or from the sides) and subsequent aspiration of the solvent-laden waste steam and/or air stream and the feeding thereof into a disposal means in order to solve the above-outlined problem. However, it was found that such a procedure is not sufficient to rid (previously) drycleaned garments from the solvents in question here to such an extent that the garments can subsequently be safely worn again. This is because not only the owners/wearers of the so-cleaned garments are endangered but also (in fact to a greater degree) those people who work in cleaning plants, since the drycleaned garments which are generally necessarily held there in sizeable numbers ready for collection create ambient air concentrations of such solvents in the rooms where they are kept which generally appreciably exceed the maximum allowable concentration (MAC) levels.

Even if it is assumed that the author of DE Offenlegungsschrift 2,146,945 assumes that aspirating the solvent-laden waste steam and/or air stream (from underneath the garments) and introducing it into a disposal means is obvious or even self-evident—since there are in fact environmental laws prohibiting the passing of such a solvent-laden steam and/or air stream into the atmosphere without prior waste treatment—it has to be noted that DE Offenlegungsschrift 2,146,945 reveals neither a process nor indeed an apparatus (in particular for small cleaning operations such as shop operations) by means of which the above-outlined problem can be solved.

This is also true of the subject-matter of U.S. Pat. No. 4,391,602, which relates to a process for smoothing and drying (previously) laundered formed articles made of a textile blend (i.e. with different fiber components), i.e. essentially or exclusively outerwear garments. Apart from the fact that U.S. Pat. No. 4,391,602 does not relate to the aftertreatment of drycleaned garments but to the aftertreatment or finishing of conventionally laundered garments which, after laundering but while still damp, are put on coat hangers in a box-shaped housing, the process known from this publication would even if it was used for aftertreating drycleaned garments lead at most to the smoothing and drying which are the object of said U.S. Pat. No. 4,391,602 but not to an effective and sufficient removal of solvent residues from previously drycleaned garments.

This is because said U.S. Pat. No. 4,391,602 teaches only, as embodied for a conventional laundering process, that the previously conventionally laundered garments be hung up wet and be heated over a relatively long time, reducing the moisture content to a desirable level. Thereafter the garments, which still have a certain residual moisture content, are mechanically smoothed by uniform flow pressure directed at their surface over a comparatively shorter time interval and they are then subjected to steam and hot air, for which purpose a steaming chamber (the apparatus known for carrying out the process of U.S. Pat. No. 4,391,602 comprises not only such a steaming chamber but also a drying chamber connected therewith in series which is connected to the steaming chamber by a conveyor or the like) is provided with inlet openings (the drying chamber contains nozzles for the inlet of hot air).

Although the subject-matter of DE Offenlegungsschrift 2,944,929 (in contradistinction to the above-reviewed U.S. Pat. No. 4,391,602) is expressly directed to an apparatus for recovering solvent residues from treated textile material which remain in the textile material from a continuous treatment of textile material in a treatment steamer even if attempts are made to drive the solvent out of the treated textile material by means of a gas heated to beyond the vaporization temperature of the solvent and condensing the solvent-containing gas, the present problem cannot be solved with this prior art apparatus either. This is because the proposal of DE Offenlegungsschrift 2,944,929 amounts solely to a chamber arrangement which is connected gastightly to the treatment chamber and is provided with a plurality of transport means for the textile material and consists of chambers separated from one another by locks, at least one of the chambers of this chamber arrangement (which is neither the first chamber nor the last chamber through which the textile material passes) being provided with a jet arrangement for blowing heated gas through the textile material and furthermore the first chamber through which the textile material to be aftertreated passes being constructed as an airing chamber and the last chamber through which the textile material passes being constructed as an equalization chamber in which an additional heating means is provided. This is because not even this continuous multichamber process leads to the necessary or desirable reduction in the residual solvent content of the previously drycleaned garments to a virtually zero or negligible level.

This is finally also true of the subject-matter of DE Offenlegungsschrift 2,932,400. Apart from the fact that this publication relates to an installation for the continuous heat treatment of textile materials which is intended as equipment for applying stiffening finishes in the textile industry, the process of this publication, even if applied to the problem at issue here, would not be suitable for solving it.

It is an object of the present invention to overcome the disadvantages and imperfections of the process as classified at the beginning and in particular improve it to the effect that previously drycleaned garments (or other textiles) are efficiently aftertreated, preferably with simultaneous smoothing, in such a way that the garments or the like are only left at most with a negligible residual solvent content, so that following the aftertreatment the garments or the like can be considered essentially or virtually solvent-free.

It is a further object of the present invention to provide an apparatus for carrying out the process of the invention whereby the process of the invention can be practiced not only in industrial drycleaning operations but in particular also within the cramped space within which in general shops operate, i.e. an apparatus which, as regards its dimensions, can still be termed closet-like and which is capable of receiving the textile contents of a full conventional cleaning drum (i.e. about 10 to 20 outerwear garments) and which, despite these considerably reduced dimensions compared with known apparatus of a similar kind, shall nonetheless make it possible to effect the above-outlined intensive solvent removal from the previously drycleaned garments, to be precise within a relatively short time interval of for example about 5 minutes, so that the invention makes it possible not only technically but also commercially to obtain a result which has hitherto been dismissed as wishful thinking by the entire cleaning trade.

To achieve the process aspect of the above-stated object, the invention provides that the garments or the like to be aftertreated be subjected in the course of the proposed steam and/or air impingement, which is effected in a conventional manner essentially only from above and/or from the side, to an appreciable vacuum which is preferably at least about 600 mm of water column, most preferably about 1000 mm of water column, and that the then solvent-containing waste steam and/or air stream be aspirated away underneath the garments in a conventional manner and thereafter be freed of solvent.

After it initially appeared to be the case in the course of the extensive development work which led to the present invention that a residual solvent concentration of about 1%, freely conceded by the manufacturers of such apparatus as being a favorable result (yet frequently not attained even at that level), could scarcely be attained, in particular in the case of small-scale plant, as required in principle for shop operations or the like, and that this value, previously evidently accepted as a favorable result, was unlikely to be bettered even in economical large-scale industrial plant (let alone in small-scale plant), a final attempt was made (as it were shortly before a resigned end was to be put to the development work) to additionally better (i.e. reduce) the previously attainable solvent concentration values by specifically increasing the low vacuum which is usually provided in such solvent disposal means and which merely has the purpose of preventing the escape of solvent-laden gases into the environment. It was found that even fairly appreciable vacuums of for example 300 or 400 mm of water column—in particular if regard is had to economic considerations—do not lead to an appreciable improvement.

Even these attempts were carried out in the face of understandable reservations that an appreciable vacuum in the aftertreatment of drycleaned garments in question here would entail other disadvantages or give rise to further or new difficulties, apart from the fact that appreciable vacuums were known to necessitate strengthening such apparatus, leading to safe-like structures.

Yet the inventor disregarded these and other associated technical and commercial prejudices and finally found to his surprise that in a process of the classification in question in which the garments to be aftertreated are then preferably also subjected to a steam and/or air flow in an optimum manner (namely from above and/or from the sides) a vacuum within the range from about 800 to 1000 mm of water column will result in a virtually dramatic removal of solvent from the garments.

This is presumably due to the fact that it is possible at such a high vacuum to overcome the binding forces between the solvent molecules and the textile fabrics and to drive the solvent molecules—with the above-described support due to the steam and/or (hot) air impingement—out of the textile material by additionally overcoming the (flow) resistances due to the textile fabric itself. Evidently, if the steam and/or air flow is right, the solvent molecules are not readsorbed either on the surfaces of the garments to be aftertreated, since or when this is prevented by the steam or air flow and at the same time aspiration is provided underneath the garments.

At any rate, the matter can be summarized by saying that the process of the present invention makes it possible to reduce the residual solvent content in drycleaned garments to a negligible level, not only in industrial-scale plant but even in closet-like, small-scale plant as can be accommodated easily even on shop premises.

More particularly, it has been found that it is advantageous to heat the garments in the course of the aftertreatment to at least 40° or 50° C., but most preferably to about 70° C., such heating being most advantageous not only for technical reasons (i.e. to obtain a minimal residual solvent content) but also for economic reasons, since under these conditions an aftertreatment can be concluded in about 5 minutes even in small-scale plant.

If for example an aftertreatment time of 20 minutes or more were acceptable, the temperature could perfectly well be lower, but such a long treatment time appears to be generally unacceptable.

Although the process of the present invention achieves, compared with the prior art, an almost incredibly good result when the garments to be aftertreated are treated in (at least) one (first) operation with steam and either simultaneously or in (at least) one (second) operation with (heated or unheated) air, it has proved extremely advantageous according to a further aspect of the present invention to subject the garments in the aftertreatment of the present invention after a first steam treatment and possibly a first or subsequent air treatment to at least a second steam treatment in which to improve the aftertreatment result and/or speed up the aftertreatment one or more successive steam and/or air treatments can be carried out.

Such an interval treatment has incidentally not alone the extremely desirable secondary effect, not least from an economic aspect, that the garments become virtually perfectly smoothed in the course of the aftertreatment of the present invention.

The process of the present invention can be further improved in a further embodiment by setting garments (at least temporarily) in vibration in the course of their aftertreatment. In this context it may be pointed out that vibrating the garments to be cleaned is admittedly known from U.S. Pat. No. 2,845,786 for the cleaning process but not in respect of the aftertreatment in question and of interest here.

In an extremely preferred embodiment of the process of the present invention, accordingly, the garments are preferably treated in interval fashion with steam and also in interval fashion with preferably preheated air from above and from the side under a vacuum of about 1 m of water column and with heating to about 50° to 80° C., they are in addition at least temporarily set in vibration, and the solvent-containing waste steam and air stream is then aspirated away underneath the garments and subsequently freed of solvent in order to arrive at an overall solution which is incidentally also extremely environmentally friendly.

The solution to the problem of achieving the apparatus part of the above-stated object with a congeneric apparatus—i.e. with an apparatus comprising an essentially closet-like housing, a steam generator or a connection for an external steam sourced steam inlet nozzles, a (compressed) air source or a connection for an external air source with or without preheating, and air inlet nozzles arranged above and/or at the side of the suspended garments to be aftertreated—consists in a vacuum source whereby an appreciable vacuum can be produced in the closet-like housing and in a conventionally provided aspirator for aspirating away the solvent-laden waste steam or air, the aspiration opening(s) being arranged underneath the garments hanging in the housing and the aspiration opening(s) being followed by a disposal means whereby the solvent present in the waste steam or air can be disposed of, which disposal means can preferably have at least one filter constructed for example in the manner of an activated carbon filter or the like.

Preferred embodiments of the present invention are described in the subclaims.

In what follows, the invention is further explained in an illustrative embodiment with reference to a drawing.

The drawing shows an apparatus 1 for aftertreating drycleaned garments 2 which after drycleaning have each been hung up on a coat hanger 3 and suspended in the apparatus 1. In the depicted illustrative embodiment, the closet-like housing 1' of the aftertreatment apparatus 1 is sufficiently large to accommodate about 15 garments 2 (when hung up), i.e. the contents of a conventional cleaning drum of the type which is customary in drycleaning shop operations.

The top part of the apparatus 1 or of its closet-like housing 1' contains, above a clothes rail 4 from which the garments 2 are each suspended by means of a coat hanger 3, a steam generator, not shown in detail. The steam generator 5 generates hot steam which is directed through nozzles uniformly arranged on the underside of the steam generator over the length L, and hence not visible in the drawing, in the direction of the arrows 6 downward onto the garments 2. These nozzles 6 form a plurality of parallel rows, so that the garments 2 are treated with steam at least essentially over their entire width W.

Instead of a steam generator 5 it would of course also be possible to provide a connection for an external steam source, which option is advantageous in particular when a steam generator is present anyhow at the site used for other purposes.

Alternatively or additionally further nozzles 5' can be present in at least one side wall of the apparatus 1 (more precisely in its housing 1') whereby the garments 2 are treated with steam, preferably from both sides, in the course of the aftertreatment. It may be pointed out here that, in the schematic drawing, one of the side walls 18 has been broken away for better clarity but that the housing 1' is of course completely enclosed during operation. In an embodiment with side nozzles 5' the garments 2 are accordingly impinged by steam in accordance with the arrows 8 (from both sides however).

The underside of the steam generator 5 and/or the side walls 17, 18 of the housing 1' are provided not only with (steam) nozzles but also with air nozzles 19 of which those which are present in the side wall 17 are each shown in the depicted embodiment as crosses for greater clarity. The air nozzles 19 communicate with a (hot) air line 20 which is supplied by an external hot air source, the control being such that steam and air can pass simultaneously or else alternately into the apparatus 1 through the steam nozzles 5' and the nozzles 19 respectively.

The clothes rail 4 is in operative connection with a vibrator 7 which can be constructed for example as an unbalance vibrator or as an electromagnetic vibrator and is capable of setting the clothes rail 4 in vibration in order ultimately to confer vibrations on the garments 2 to be aftertreated. In this arrangement, the hooks 3' of the coat hangers 3 can be connected more intimately to the clothes rail 4 using clamping hoods 21 or the like in order to keep the vibratory effect imparted to the garments 2 as intensive as possible.

The housing 1' communicates with a vacuum source, not depicted, via a connection pipe 22 which is advantageously situated in the upper part of the housing 1' in order to minimize the amount of solvent supplied to the vacuum source which is connected to a solvent disposal means.

As for the rest, a disposal chamber 10 provided in the bottom end section of the apparatus 1 contains a suction blower 11 whereby the solvent-enriched waste steam or air can be aspirated away through topside openings 16 in the disposal chamber 10, the waste steam which passes into the disposal chamber 10 being at least partially condensed therein and the condensate being sent to a condensate container, which is not depicted in detail. As for the rest, the waste steam then passes through an activated carbon filter 12 into a discharge pipe 13 and passes from there to a heat recovery means, not depicted.

In principle, of course, the suction blower 11, if appropriately designed, can also form the vacuum source for the apparatus 1 or the interior thereof, but in this case it requires appreciably larger dimensions, since in the course of the aftertreatment of the garments 2 a vacuum of 1000 mm of water column is generated inside the apparatus 1, the creation and maintenance of which demands a suitably powerful vacuum source.

The working of the apparatus shown in the schematic drawing is essentially as follows:

To charge the apparatus 1 with the garments 2 to be aftertreated, the side wall 18, of which only part is shown in the drawing, is opened. To be precise, the side wall 18 consists of two leaved doors or has leaved doors such that, when they are closed, the apparatus 1 is gastightly sealed (even against the appreciable vacuum of 1 m of water column). As soon as the garments 2 to be aftertreated have each been suspended from the clothes rail 4 by means of a coat hanger 3 and the hooks 3' thereof have been intimately connected to the clothes rail 4 with clamping hoods 21 or in some other way, the side wall 18 is firmly closed, the vibrator 7 is switched on, so that the garments 2 are subjected to vibration, and hot steam generated by the steam generator 5 is introduced through the steam nozzles 5' and impinges accordingly in the direction of the arrows 6 (from above) and 8 (from the sides) on the garments 2.

At the same time or beforehand the inside of the apparatus 1 has been put under a vacuum of about 1000 mm of water column via the connection pipe 22.

After a relatively short operating time, the steam flow is then cut back or switched off and hot air is introduced into the apparatus through the air nozzles 19 from above and from the sides and the hot airstream likewise impinges on the garments 2. At the same time, essentially throughout the entire aftertreatment, an operating temperature of about 70° C. is established immediately with the start of operation and maintained by open or closed loop control.

A first hot air treatment is then followed in interval fashion by a second steam treatment, then again by a hot air treatment and so on, with the suction blower 11 operating throughout the entire aftertreatment cycle, so that solvent-containing waste steam or air is continuously aspirated away through the openings 16 of the disposal chamber and conveyed toward the filter 12.

The aftertreatment is complete after a total treatment time of about 4.5 minutes. The apparatus is then disconnected from the vacuum source and the pressure is allowed to equilibrate. Thereafter the side wall 18 can be opened to remove the now virtually solvent-free, smoothed garments 2, while the blower 11 may continue to operate, although this will generally not even be necessary, since the residual concentration of the solvent in the chamber after the treatment cycle described is virtually zero.

To finish, it may additionally be pointed out that in general it is certainly not a problem if the region 15 which contains the suction blower 11 plus the filter is smaller in respect of its clear height than the adjacent region 14, since a charge removed from a cleaning drum will in general contain only a few relatively long garments 2 such as coats or the like and a multiplicity of shorter garments such as jackets or the like, so that the former can be hung up in the taller region 14 and the latter in the shorter region 15.

LIST OF REFERENCE NUMERALS

1 Aftertreatment apparatus
2 Garments
3 Coat hangers (for 2)
4 Clothes rails
5 Steam generator
6 Steam or air direction
7 Vibrator
8 Steam or air direction
9 Waste steam or air
10 Disposal chamber
11 Suction blower
12 Filter
13 Discharge pipe
14 Tall region
15 Shorter region
16 Aspiration openings (of 10)
17 Side wall (of 1 or 1')
18 Side wall (of 1 or 1')
19 (Air) nozzles (in 17)
20 (Hot) air line
21 Clamping hoods
22 Connection pipe
1' Closet-like housing (of 1)
3' Hooks
5' (Steam) nozzles

I claim:

1. Apparatus for aftertreating drycleaned garments comprising a closet-like housing, a steam generator or an external steam source, steam inlet nozzles, an air source, and air inlet nozzles arranged above and/or at the side of the garments to be aftertreated characterized by a vacuum source whereby an appreciable vacuum is to be produced in the housing and a suction blower for aspirating away the solvent-laden waste steam and/or air, the aspiration opening(s) being arranged underneath the garments hanging in the housing and the aspiration opening(s) being followed by a disposal means wherein the solvent present in the waste steam and/or air is to be disposed of.

2. Apparatus of claim 1, wherein the disposal means has at least one activated carbon filter.

3. Apparatus of claim 1, wherein the connection for the vacuum source is arranged in the upper section of the housing.

4. Apparatus of claim 1, characterized by a vacuum source whereby a vacuum of more than 700 mm of water column can be produced in the housing.

5. Apparatus of claim 1, characterized by a vibration means whereby the garments to be aftertreated can be set in vibration in the course of the aftertreatment.

6. Apparatus of claim 1, characterized by fixing means whereby the garment coat hangers or hooks can be connected essentially fixedly to the vibration means.

7. Apparatus of claim 1, wherein the clear height of a housing or of the chamber surrounding it is greater in a section than in another section.

8. Apparatus of claim 1, wherein the closet-like housing has at least one side wall constructed as a door or doors which can be opened and gastightly and pressure-tightly sealed during operation.

9. Apparatus according to claim 1, wherein the air source is compressed.

10. Apparatus according to claim 1, wherein the apparatus further comprises a vacuum source whereby a vacuum of at least about 1 m of water column can be produced in the housing.

* * * * *